United States Patent [19]

Betts

[11] Patent Number: 4,714,393

[45] Date of Patent: Dec. 22, 1987

[54] PANEL LAYING MACHINE

[75] Inventor: Kenneth H. Betts, Mississauga, Canada

[73] Assignee: Construction Specialties Limited, Mississauga, Canada

[21] Appl. No.: 689,682

[22] Filed: Jan. 8, 1985

[51] Int. Cl.[4] ..... E01C 11/23

[52] U.S. Cl. ..... 414/10; 180/271; 294/88; 294/907; 414/21; 414/608; 414/730

[58] Field of Search ..... 414/626, 730, 21, 608, 414/607, 10; 294/111, 907, 112, 86.4, 88; 212/149, 150, 155, 251; 901/34; 180/271, 277, 279, 289, 290, 173

[56] References Cited

U.S. PATENT DOCUMENTS

| | | | |
|---|---|---|---|
| 2,812,070 | 11/1957 | Delzer | 414/626 X |
| 2,917,189 | 12/1959 | Isaacs | 212/238 |
| 2,989,197 | 6/1961 | Werner et al. | 414/758 |
| 3,027,019 | 3/1962 | Miller | 414/626 X |
| 3,039,632 | 6/1962 | Wise et al. | 404/99 X |
| 3,199,698 | 8/1965 | Schuster | 180/271 X |
| 3,734,325 | 5/1973 | Stone | 414/626 |
| 3,867,051 | 2/1975 | Bjorhaag | 404/99 |
| 3,888,362 | 6/1975 | Fletcher et al. | 414/626 X |
| 3,895,498 | 7/1975 | Manthey et al. | 414/626 X |
| 4,007,847 | 2/1977 | Marco | 180/271 X |
| 4,168,130 | 9/1979 | Barth et al. | 404/99 |
| 4,303,269 | 12/1981 | Faughnan | 294/88 |

FOREIGN PATENT DOCUMENTS

| | | | |
|---|---|---|---|
| 2248397 | 4/1974 | Fed. Rep. of Germany . | |
| 2426713 | 12/1975 | Fed. Rep. of Germany . | |
| 2602442 | 7/1977 | Fed. Rep. of Germany | 294/86.4 |
| 2910719 | 10/1980 | Fed. Rep. of Germany . | |
| 53-83260 | 7/1978 | Japan | 212/149 |
| 1553292 | 9/1979 | United Kingdom | 414/608 |
| 981183 | 12/1982 | U.S.S.R. | 294/88 |

*Primary Examiner*—Robert J. Spar
*Assistant Examiner*—Janice Krizek
*Attorney, Agent, or Firm*—Rogers, Bereskin & Parr

[57] ABSTRACT

A panel laying machine for use as a "power assist" in installing access flooring. The machine includes a self-propelled chassis, a mast extending upwardly from the chassis and a jib turnably mounted on the mast. A panel gripper head is suspended from the mast by a cable coupled to a winch on the jib and the gripper head includes controls manually operable by an operator to raise and lower the panel, release the panel from the gripper head and move the chassis. A safety interlock is provided so that the panel cannot be released by the gripper head while the suspension cable is supporting a load above a predetermined limit.

26 Claims, 8 Drawing Figures

PANEL LAYING MACHINE

FIELD OF THE INVENTION

This invention relates to a machine for raising and lowering panels such as concrete flooring panels, and is concerned more particularly (but not exclusively) with a machine which can be used as a "power assist" in the laying of such panels. For convenience a machine of this type will be referred to as a panel laying machine.

BACKGROUND OF THE INVENTION

Flooring known as "access flooring" is often used in commercial buildings to provide a false floor above a structural floor, so as to define as access space below the false floor. Air conditioning ducting, cables etc. can then be readily laid in the access space without the necessity of forming special channels in the floor. Commonly, access flooring is provided in computer rooms and like installations, where a large number of electrical cables must be accommodated and where it is necessary to be able to readily gain access to the cables.

One known type of access flooring uses lightweight concrete flooring panels installed on pedestals, which themselves are located on the base floor. Traditionally, the panels are installed manually by a crew. The panels are lifted individually from a stack on a skid and manually positioned on the pedestals. This is labour intensive and time consuming. Further, installation or removal of a panel, where the surrounding positions are already filled with panels, can be difficult to carry out manually.

Accordingly, the present invention has been devised with the objective of providing a machine which can be used to facilitate the laying and removal of such panels.

BRIEF SUMMARY OF THE INVENTION

In accordance with the present invention, there is provided a panel laying machine, which comprises: a chassis; support wheels rotatably mounted to the chassis; a mast extending upwardly from the chassis; a jib mounted on the mast for turning about a vertical axis relative to the chassis; panel gripper means including a plurality of gripping elements engageable with a panel to selectively grip or release a panel; a flexible elongate support element suspending the gripper means from the jib; drive means carried by the jib for displacing the support element to raise and lower the gripper means, the gripper means including operating means manually actuable by an operator to cause the gripping elements to selectively grip or release a panel; load sensor means for sensing the load carried by the support element and coupled to said gripper operating means so as to maintain the gripping elements in engagement with a panel and prevent release thereof while the load sensor means senses that the load carried by the support element exceeds a predetermined value.

The load sensor of the machine thus provides a safety feature, in that it senses the load carried by the machine, and does not permit the release of a panel whilst it is still supported by the support element (e.g. a cable). When placing a panel in position, the load has to be released from the support cable, before the gripping elements can be be operated to release the panel. Accordingly, in normal usage, it should be impossible to accidentally drop a panel.

The panel laying maching of the present invention may include a number of advantageous features, some of which are indicated below:

The gripper means may include a frame, at least one fixed gripping element, a fluid pressure-operated cylinder for moving a movable gripping element, and a manually operable valve mounted on the frame for controlling the cylinder. The gripper means may also carry manually operable controls for operating the drive means (e.g. a winch) for the support element, so that a single operator can raise and lower a panel as well as operate the gripper means.

A drive motor can be provided on the chassis for driving the chassis support wheels. A compressor driven by a motor can also be provided on the chassis for delivering compressed air where the gripper means are pneumatically operated. The drive motor and winch can be electrically powered, and an electrical interlock provided so that the two motors cannot be operated at the same time, to limit electrical demand. A timer device can be provided for timing power supply to the drive motor on the chassis, so that the machine will advance automatically.

A detachable trolley can be included to carry a supply of panels to be laid. The trolley can be securely attached to the chassis, and preferably includes a steering lock to lock the steerable wheels of the trolley when it is attached to the chassis.

The panel laying machine can be made in a number of separate components, which can be readily secured to one another to form the machine or disassembled for transportation.

BRIEF DESCRIPTION OF THE DRAWINGS

For a better understanding of the present invention and to show more clearly how it may be carried into effect, reference will now be made, by way of example, to the accompanying drawings, which show an embodiment of the present inventions, and in which.

DESCRIPTION OF THE PREFERRED EMBODIMENTS

Figure 1:
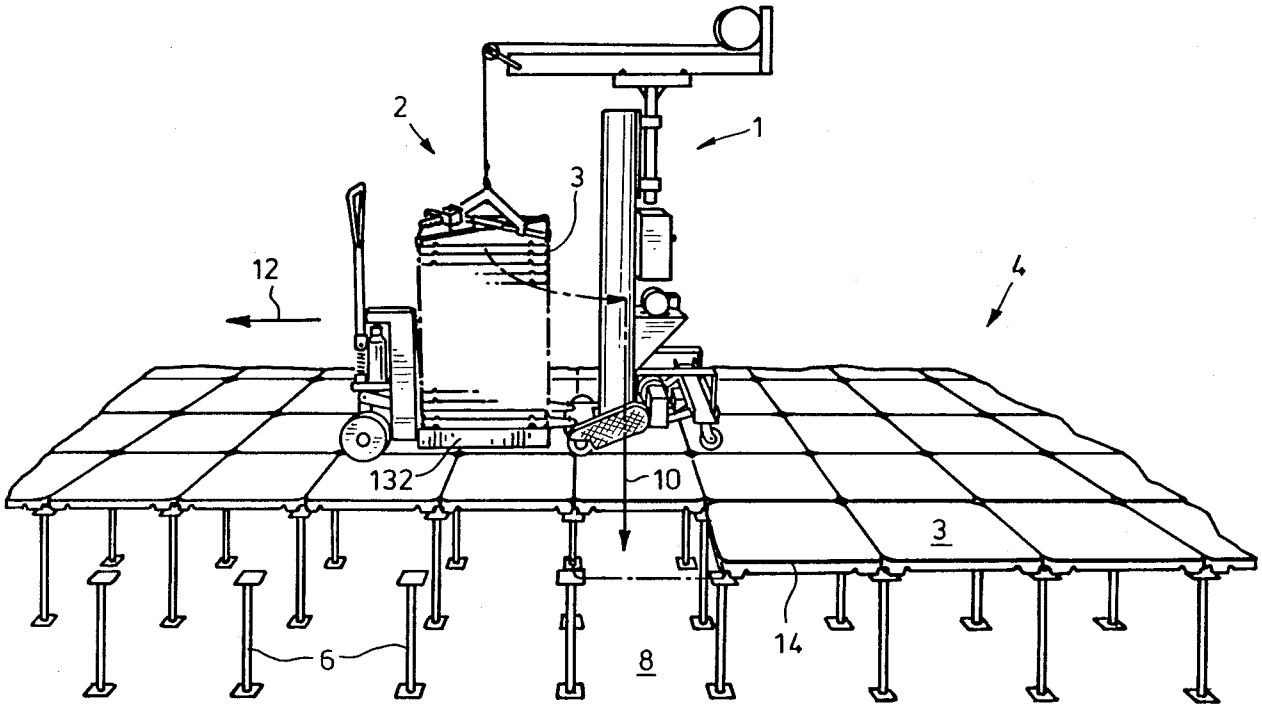
FIG. 1 is a perspective view of a panel laying machine according to the present invention, shown in use for installing access flooring.

Referring first to FIG. 1, a panel laying machine is generally denoted by reference numeral 1. The machine 1 is shown attached to a steerable trolley generally designated by the reference numeral 2. On the steerable trolley 2 is shown a stack of panels 3.

The machine 1 is shown on an area of access flooring generally indicated by reference numeral 4. The access flooring 4 comprises a plurality of pedestals 6, extending upwards from a base floor indicated by the reference numeral 8. The pedestals 6 are located on a square grid pattern corresponding to the dimensions of the panels 3, and each panel 3 is located with its corners resting on corresponding corners of four adjacent pedestals 6.

In principle, machine 1 can be used to lift and remove, or place (lay) panels in position, although the machine has been designed specifically for panel laying. In FIG. 1, an arrow 10 indicates the lifting and placement of panels 3 from the stack 5, to form a row of panels indicated by reference numeral 14. An arrow 12 indicates the forward movement of the machine 1, as the row of panels 14 is laid. The detailed structure and operation of the machine is described in greater detail below.

Figures 2, 3:
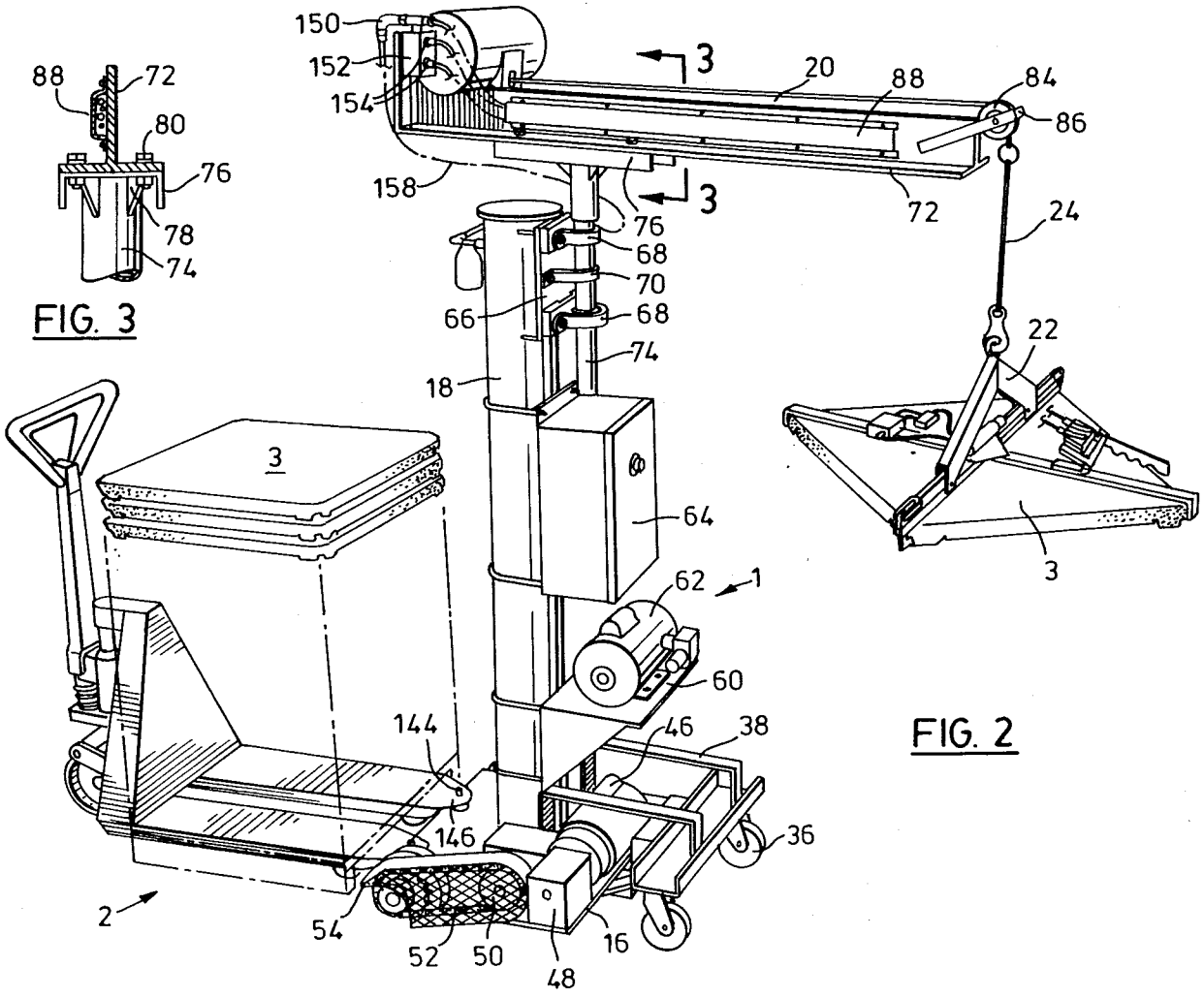
FIG. 2 is a perspective view, on a larger scale, of the panel laying machine of FIG. 1.
FIG. 3 is a sectional view along the line 3—3 of FIG. 2.

Turning now to FIG. 2, the machine 1 includes a chassis 16, and extending upwardly from the chassis 16, a mast 18. On the mast 18, is a turnably mounted jib 20. A gripper device 22 is suspended by a support cable 24 from the jib 20.

Figure 5:
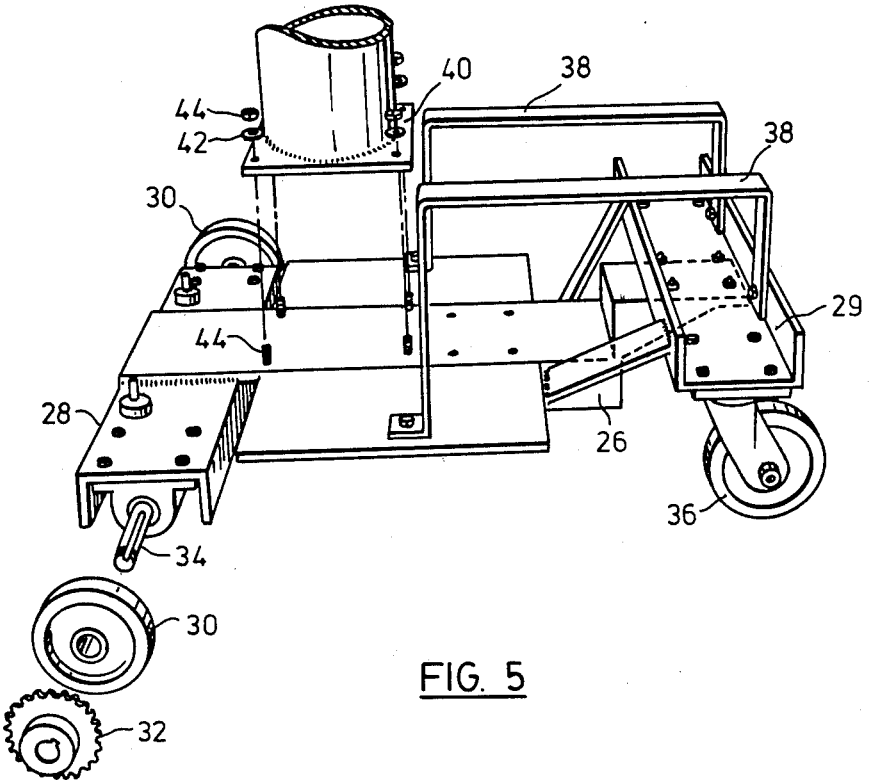
FIG. 5 is a perspective and partially exploded view, of a chassis and associated components of the panel laying machine.

With reference to FIGS. 1 and 5, it will be seen that the chassis 16 has a longitudinally extending member 26. with two transversely extending beams 28, 29 welded thereto. Drive wheels 30 and a drive gear 32 are secured to a shaft 34 rotatably mounted to the transverse beam 28. The transverse beam 29 is positioned higher than the transverse beam 28, and two rear wheels 36 are mounted as caster wheels to the beam 29. The chassis 16 includes two strips 38. A bottom end of the mast 18 includes a mounting plate or flange 40, which includes four holes 42. Corresponding holes are provided in the longitudinally extending member 26, so that the mast 18 can be bolted to the chassis 16 by means of nuts and bolts 44. As noted below, this enables the machine to be readily dismantled into easily handled components.

On the chassis 16, there is mounted an electric drive motor 46, which drives the gear or sprocket 32 via a gear box 48, a drive sprocket 50 and a chain 52; a guard 54 is also provided in known manner.

The mast 18 is generally tubular, and is secured to the chassis 16 by the nuts and bolts 44. Mounted on the mast 18 is an outwardly extending platform 60 for an electrically driven air compressor 62. Above the air compressor 62, is a timer 64, the function of which is described in detail below. Both the platform 60 and the timer 64 are secured to the mast 18 by means of U-shaped brackets and nuts. At the top of the mast 18, is a mounting plate 66 welded to the tubular part of the mast 18. Clamped to the mounting plate 66 are two bearings 68. Additionally, a braking strap 70 provides a frictional restraint on free turning of the jib.

The jib 20 includes a main, horizontal beam 72 of generally I-shaped cross-section. A vertical shaft 74 is secured to an inverted U-shaped channel 76 at the underside of jib 20, and is received in the bearings 68. The channel 76 and beam 72 are provided with corresponding holes, so that they can be bolted together by nuts and bolts 80. Again, these nuts and bolts 80 permit the machine to be readily dismantled.

At the rear end of the jib 20, there is a winch 82, which is driven by an air-powered motor. At the front end of the jib 20, there is a pulley 84 supported in a bracket 86. A support cable 24 extends from the winch 82 over the pulley 84 to the gripper device 22. A shallow channel-section member 88 extends along one side of beam 72, for protecting and locating various cables, hoses etc. (see FIG. 3).

Figure 4:
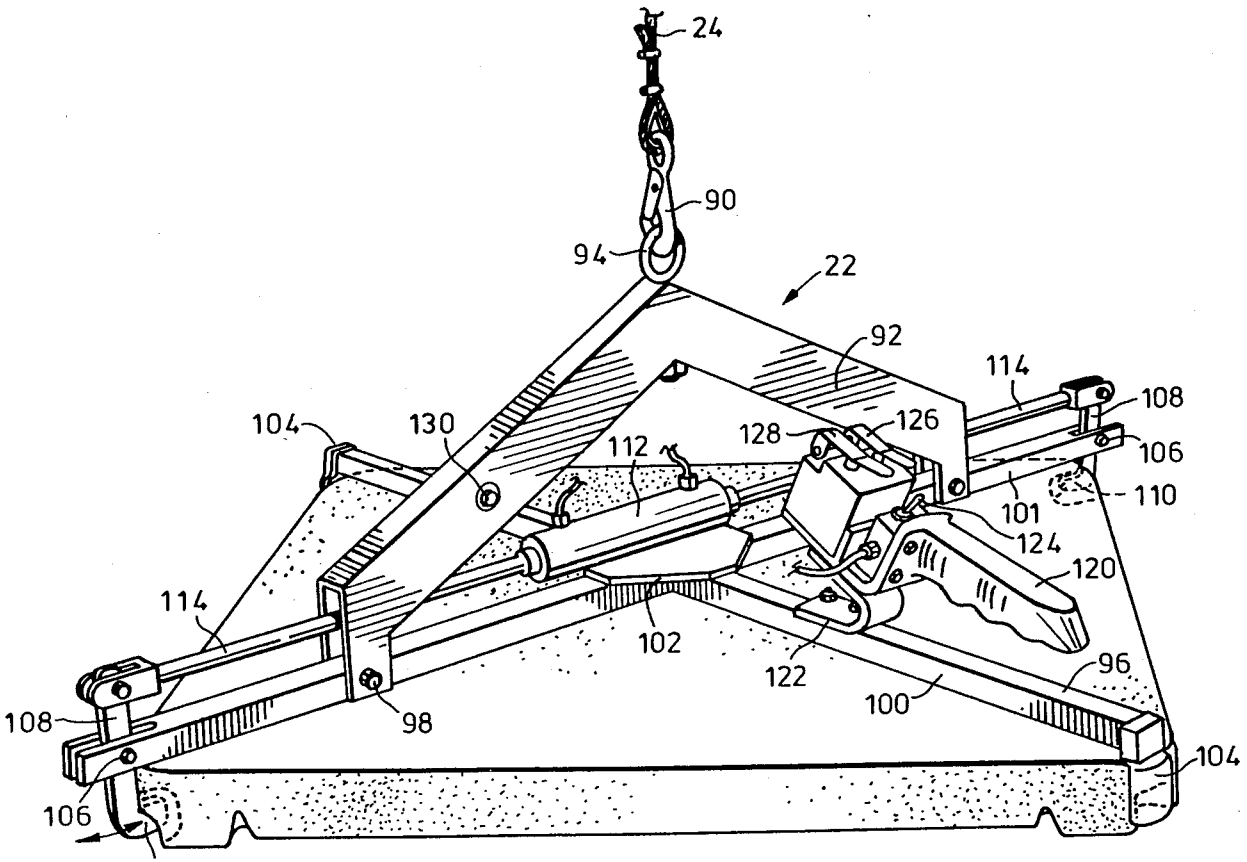
FIG. 4 is a perspective view, on a larger scale, of a gripper device of the panel laying machine.

FIG. 4 shows details of the gripper device 22. At the lower end of the support cable 24, there is a hook 90, which permits the gripper device 22 to be detached from cable 24. A supporting frame 92 is formed from inverted U-shaped channel sections, and is supported from the hook 90 by a ring 94 of the frame 92. A main frame 96 is bolted at 98 to the support frame 92. The main frame 96 comprises two elongate elements 100, 101, which are welded together in a crossed configuration and to a central plate 102. At either end of the elongate element 100, there are fixed gripping elements 104. The ends of the elongate element 101 are formed as slots. Bolts 106 extending across these slots form pivots for movable gripping elements 108. Each movable gripping element 108 is elongate, and includes an inwardly directed catch 110 at its lower end. A pneumatic cylinder 112 is secured to the main frame 96, and includes a piston (not shown) carried by actuator rods 114. Each rod 114 is pivotally attached to a respective movable gripping element 108.

A handle 120, and associated switches are provided for maneuvering the gripping device 22, and for operating the pneumatic cylinder 112, the electric drive motor 46 and the air driven winch 82. The maneuvering handle 120 is secured by a bracket 122 to the main frame 96. An actuating switch 124, for the pneumatic cylinder 112 is mounted on a maneuvering handle 120. Also, two switches 126, 128 are mounted on the handle 120 for controlling the winch 82. Additionally, support frame 92 carries a button 130 for actuating the drive motor 46, via the timer 64, as explained below.

Figure 6:
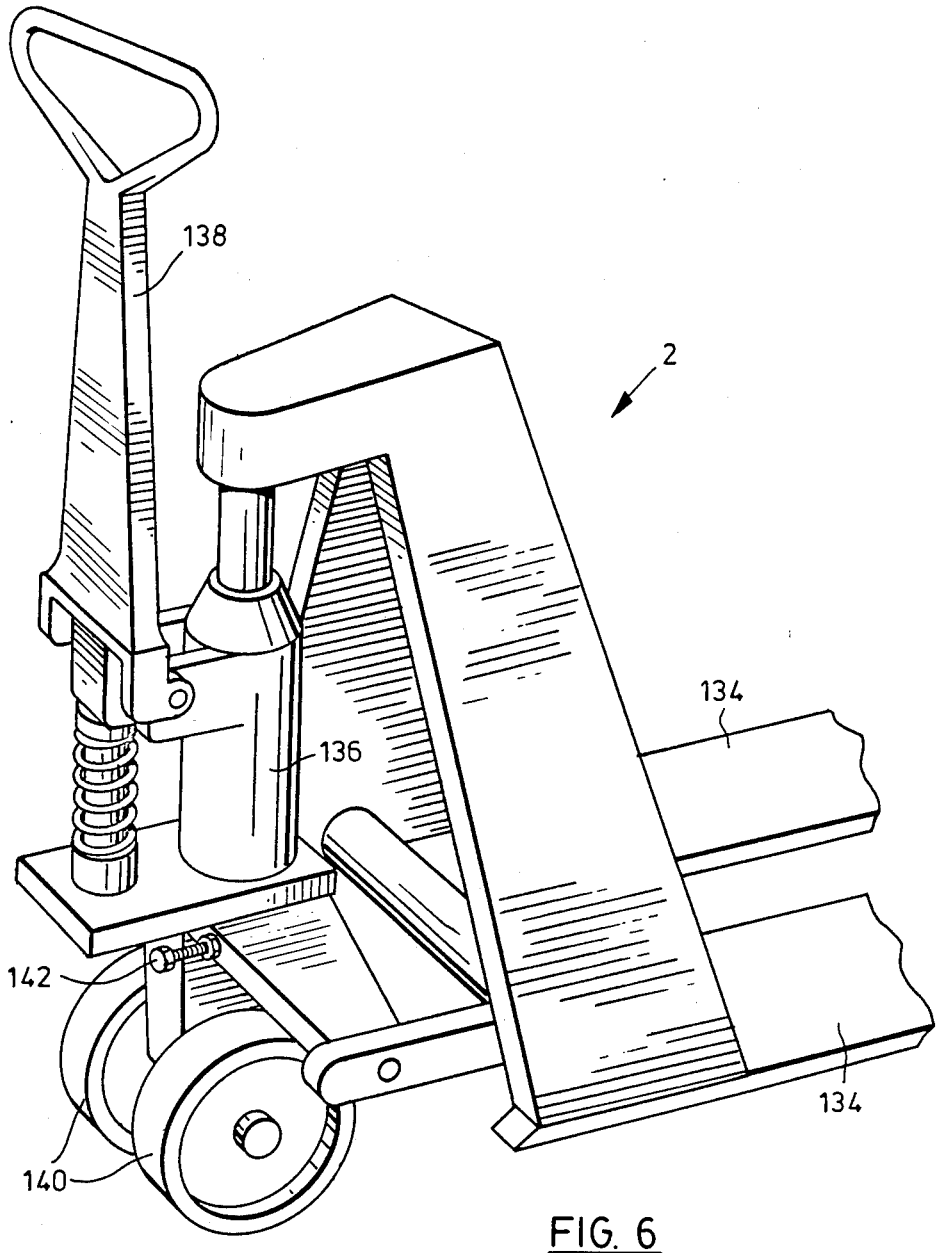
FIG. 6 is a perspective view of part of a trolley and a steering brake.

The steerable trolley 2 can be of largely conventional construction and in this case is a modified version of a conventional "pump truck". The trolley should be suitable for lifting a pallet, such as a pallet 132 in FIG. 1, on which panels 3 are stacked. For this purpose, the trolley includes two forks 134, as shown in FIG. 6. The wheels of the trolley 2 are mechanically linked, and can be moved between up and down positions by a hydraulic jack 136. A handle 138 serves both for maneuvering the trolley 2 and for actuating the hydraulic jack 13. The trolley can thus be inserted under a pallet, and then the forks 134 lifted to lift the pallet and its load off the ground. At the back of the trolley 2, rear wheels 140 are mounted together with the jack 136 and handle 138 on a part which is rotatable relative to the main frame of the trolley. The features of the trolley 2 are largely conventional, and will not be described in greater detail here.

In the present case, when the trolley 2 is attached to the panel laying machine 1, it is desirable to lock all its wheels, so that they cannot pivot. With reference to FIG. 6, this is achieved by providing a steering brake 142. This steering brake 142 comprises a bolt engaged in a threaded bore, for locking the rear wheels 140 and associated parts of the trolley 2, so they cannot rotate relative to the main frame of the trolley 2. Bolt 142 frictionally engages a shaft (not shown) which turns when the wheels 140 turn; by tightening the bolt against the shaft the wheels 140 can be locked. If required, a locking nut can be provided on bolt 142.

It is to be appreciated that various other types of steering brake can be provided, the basic requirement being that the steerable wheels 140 of the trolley 2 are locked into position. For example, the steering brake 142 could comprise a spring-loaded pin, that can be released from a catch so that it engages a bore or recess in the shaft. This provides for quicker and simpler operation.

For attachment to the machine, tips of the forks 134 are provided with holes 146 for receiving corresponding pins on the machine. Thus, the trolley 2 would be brought up to the machine 1 with the forks 134 raised to their highest level. The chassis 16 is provided with pins 144 corresponding to the holes 146. The trolley 2 is maneuvered to bring the holes 146 above the pins 144. Then, the forks 134 are lowered sufficiently for the pins 144 to fully engage the holes 146. The dimensions are such that a pallet 132 on the trolley 2 is still clear of the ground. With the steering brake lock 142 on, the machine 1 and trolley 2 will then function as a four-wheeled non-steerable vehicle, that will travel in a straight line. The castor wheels 36 will simply follow the course set by the other wheels. To turn the machine 1 together with the trolley as required at the end of a row of panels, the steering brake 142 is released. The handle 138 of the trolley 2 can then be used to maneuver the combined trolley/machine 1,2.

A description will now be given of the circuits shown in FIGS. 7 and 8; in the other figures various wires and air hoses etc, of the circuits have been omitted for clarity. Thus, for example, in FIG. 4, the interconnections between the pneumatic cylinder 112 and the actuating switch 124 are not shown. Also, there are numerous air hoses and wires which have to extend along the support cable 24 to the gripper device 22. These wires and air hoses extend behind the cover plate 88, and are then coiled at the end of the jib 20. The coils then provide sufficient lengths of the wires and hoses to accommodate vertical movement of the gripping device 22. These aspects of the layout of the wires and hoses are conventional, and will not be described in great detail.

From the air compressor 62, an outlet hose (not shown) is led upwards to a bracket 150 at the rear end of the jib 20 (FIG. 2). The air supply is connected to a valve 152 for controlling operation of the air-powered winch 82. For this purpose, two control hoses 154 lead off from the control valve 152 to the gripper device 22. Further, an extension of the air supply hose, indicated at 156 extends along the jib 20 towards the gripper device 22. Mast 18 may be constructed as a pressure vessel forming a reservoir for the air used to actuate the various pneumatic devices of the machine. In this case, compressor 62 would be arranged to pressurize the air in the reservoir.

The timer 64 is connected to the drive motor 46, and has a control wire or cable leading up to the jib 20, and then along the jib 20 to the gripper device 22. For simplicity, the wire is associated with the air supply cable, and bound to it. A chain dotted line 158 indicates part of a possible route for the air supply hose and this control wire.

Figure 7:
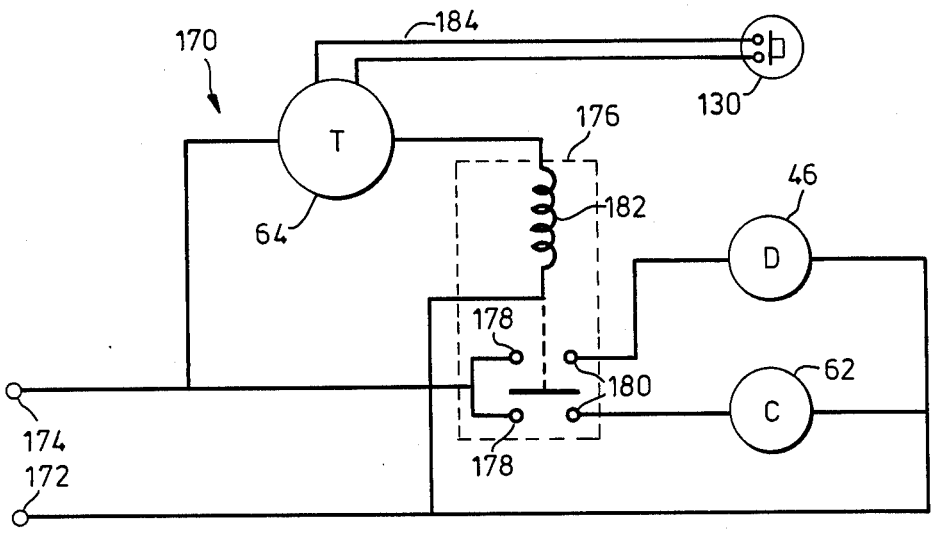
FIG. 7 shows schematically an interlock circuit for drive and compressor motors; and, FIG. 8 shows schematically a safety interlock circuit for the gripper device.

Referring to FIG. 7, there is shown an interlock circuit, generally denoted by the reference 170. As shown, the interlock 170 includes the timer 64, the motor 46 and the air compressor 62. Additionally, the control button 130 is shown. Input terminals 172, 174 are provided for a conventional, single phase 110 volt AC supply. The terminal 174 is connected directly to contacts 178 of a relay 176. Corresponding contacts 180 are connected respectively to the electric drive motor 46 and the air compressor 62, which in turn are connected to the other terminal 172. The relay 176 includes an actuating coil 82, connected between the timer 64 and the terminal 172. As shown, the button 130 can provide connection between two lines 184 from the timer 64.

In use, the relay 176 is such that usually the lower contacts 178, 180 are connected to provided power to the compressor 62. The relay 176 can be spring-loaded for this purpose. When an operator of the machine 1 desires to move the machine, he pushes the button 130 on the gripper device 22. This closes a circuit, causing the timer to start. The timer then actuates the relay 176 for a set period. While the relay is actuated, power to the compressor 62 is interrupted, and the upper contacts, 178, 180 are connected, to supply power to the electric drive motor 46. At the end of the time set by the timer, the relay 176 is de-energized, permitting it to return to the position in which power is fed to the compressor 62. By this means, it is impossible to simultaneously supply power to both the motor 46 and the compressor 62, thereby preventing overload of the power supply.

Figure 8:
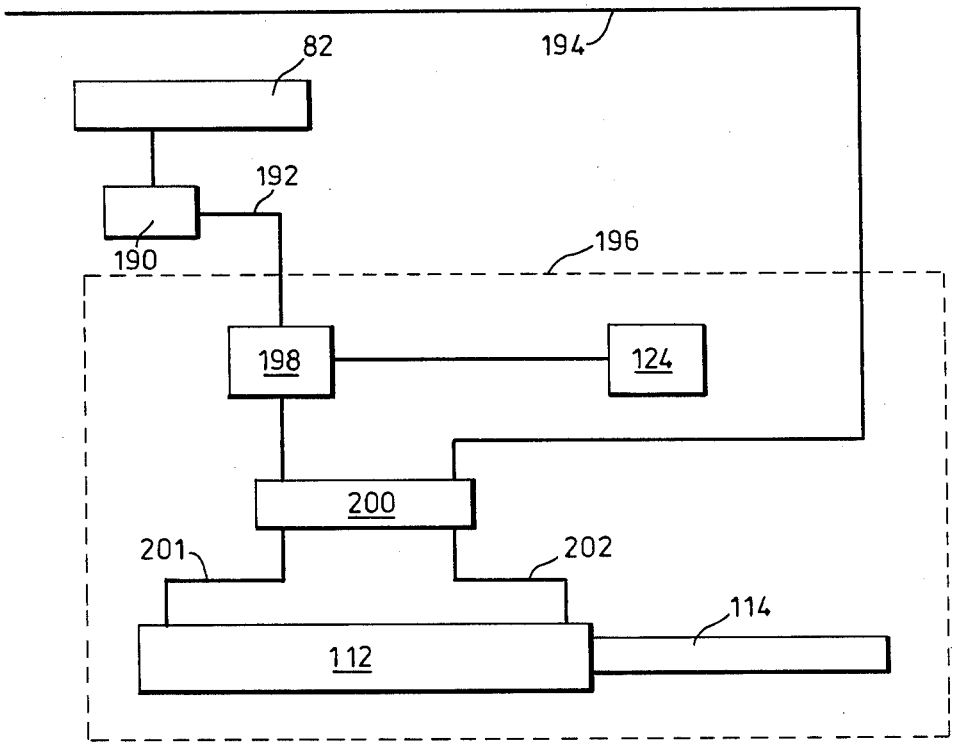

Referring now to FIG. 8, there is shown a safety interlock circuit for the gripper device 22. The panels 3 carried by the gripper device 22 can be quite heavy, and it is desirable to ensure that a panel 3 cannot be accidentally released, before it is placed into position. This is achieved by providing a load sensor, for sensing the load on the support cable 24. This load sensor is incorporated in the winch 82, and is pneumatic. Accordingly, there is an additional pneumatic hose (not shown in the other figures) extending from the winch 82 to the gripper device 22, for signalling the presence or absence of a load on the support cable 24. In FIG. 8, the winch is shown schematically at 82, and a load sensor is shown schematically at 190. A line from the load sensor 190 is shown at 192. An air supply hose, carrying compressed air from the compressor 62 is shown at 194. The gripper device 22 is indicated schematically by the box 196, all the components within the box being carried by the gripper device 22. The air supply hose 194 is connected to the actuating switch 124 and an air control valve indicated schematically at 200. The actuating switch 124 is also connected to a lock-out valve 198, which is connected to the line 192 from the load sensor. The lock-out valve 198 in turn is connected to another input of the air control valve 200. The air control valve 200 has two outlet ports, which are connected to first and second inlet ports 201, 202 of the pneumatic cylinder 112. The pneumatic cylinder 112 is shown schematically, with just one actuating rod 114.

In use, pressurized air is supplied by the line 194 to the actuating switch 124 and to the control valve 200. In the absence of a signal from the lock-out valve 198, the control valve 200 maintains a position in which pressurized air is supplied to the first inlet port 201, for maintaining the gripper device 22 in a closed position in which a panel 3 is held by the movable gripping elements 108. For this purpose, the control valve 200 can include a spring-loaded valve element, which is maintained in this closed position by the spring. When the operator wishes to release a panel 3, the actuation switch 124 is operated, so that compressed air is supplied to the lock-out valve 198. The lock-out valve 198 is such that this pressurized air signal from the switch 124 is only transmitted to the control valve 200 if there is no load sensed by the load sensor 190. If the sensor 190 senses a load exceeding a preset value, then the lock-out valve is actuated, so as to block any control signal from the actuating switch 124. As a result, it is only possible to open the gripper device 22 when there is no load carried by it. When there is no load, the signal from the switch 124 is transmitted freely to the control valve 200. The control valve 200 then is switched to a position, in which compressed air is supplied to the second inlet 202 of the pneumatic cylinder 112. The actuating rods 114 are then withdrawn, to open the gripper device 22, thereby releasing a panel held by it.

Having now described the individual components of the panel laying machine 1, a description will now be given of the use of the panel laying machine 1 both to lay and remove panels.

With reference primarily to FIG. 1, to install access flooring, the pedestals 6 are first mounted in known manner. Then, after some of the panels 3 have been positioned by hand or otherwise, the panel lifting machine 1 is placed on the already laid panels 3. An operator then uses a trolley 2 to collect a stack 5 of the panels 3. In known manner, the panels 3 will be stacked on a pallet 132 and this is lifted up by the steerable trolley 2. The trolley 2 is then maneuvered by hand, to bring the ends of the forks 134 against the machine 1. The forks are then lowered sufficiently for the holes 146 to engage the pins 144, whilst keeping the pallet and stack of panels 3 clear of the floor.

The machine 1 has already been positioned for running parallel to a row where panels 3 are to be laid. It is positioned as shown adjacent a space for a panel 3, with the jib 20 positioned as shown. An operator then grasps the gripper device 22 and the maneuvering handle 120. By use of the switches 126, 128, the gripper device 22 is then lowered until it engages a panel 3 at the top of the stack 5. As there is then no load on the gripper device 22, the movable gripping elements 108 can be maintained in an open position. The switch 124 is then actuated, to cause the elements 108 to grip or engage the panel 3. Then, by operation of the winch 82, the gripper device 22 and the panel 3 are lifted.

The operator then swings the gripper device 22 and the jib 20 around to bring the panel above the space available for it. As indicated by the arrow 10, by operation of the winch 82, the panel 3 can be lowered onto the free pedestals 6. Since the actuating switches 126, 128 for the winch 82 are on the gripper device 22, the operator need never take his hands off the gripper device 22. All this time, the load of the panel 3 will be sensed by the load sensor 190, and by means of the lock-out valve 198 the operator will be prevented from opening the gripper device 22. Thus, the panel cannot be accidentally dropped.

The panel 3 can be lowered into position next to adjacent panels; each panel has rounded corners to provide clearance for the gripping elements 104, 108. When the panel 3 has been placed on the pedestals 6, the load is taken off the support cable 24. The lock-out valve 198 is then opened, so that the operator by means of the actuating switch 124 can open the movable gripping elements 108 of the gripper device 22. The gripper device 22 can then be raised up by the winch 82 and returned to collect another panel 3 from the stack 5.

Once a panel 3 has been laid, the operator can move the panel laying machine forward, so that it is adjacent the next space for a panel 3. This is achieved by simply pressing the button 130. The timer 64 then operates the drive motor 46 for a sufficient period of time for the machine 1 to move the width of one panel 3. Thus, the machine 1 is automatically brought adjacent the position for the next panel 3. The operator can then repeat the sequence of using the gripper device 22 to lift a panel 3 from the stack and place it into position.

Thus, it will be seen that the machine 1 enables a single operator to readily lay all the panels of a floor. All the controls are mounted on the gripper device 22, which makes for easy and efficient operation. Further, the operator can readily maneuver the gripper device 22 both to grasp a panel 3 from the stack, and to position it in its current location. The machine 1 and the trolley 2 are driven together across the floor, to lay each row of panels. At the end of each row, the machine 1 and the trolley 2 will be moved sideways onto the last laid row of panels, ready to lay the next row. If desired, for this purpose, the trolley 2 can be momentarily separated from the machine 1. The trolley 2 would be re-attached to the machine 1, once the machine 1 is in the correct position.

It is to be appreciated that the machine 1 can be used equally well for the removal of panels 3. In this case, the operating sequence is simply reversed. Considering the FIG. 1 view, the machine 1 would be moved to the right, to be adjacent the last panel 3 at the end of the row 14. The operator would then maneuver the gripper device 22 to bring it down onto that panel 3. By means of the switch 124, the pneumatic cylinder 112 would then be operated to cause gripping elements 108 to grasp the panel 3. The panel 3 would then be lifted up to above the top of the stack 5 and then swung around above the stack 5, in the reverse direction to that indicated by the arrows. The operator can then lower the panel 3 so that it is accurately placed on top of the stack 5. Once placed on the stack 5, with no load then on the cable, 224, the gripping elements 108 can be opened, to release the panel 3. The operator can then repeat the sequence to remove the next panel. Again, in this case, the timer 64 can be operated to move the machine 1 in increments, corresponding to the width of the panels 3. Once a pallet on the trolley 2 has been loaded with panels 3, then the trolley 2 would be detached from the machine 1 and the stack 5 of panels removed. The trolley 2 would then be returned with a fresh, empty pallet, and re-attached to the machine 1, by means of the pin and hole arrangement 144, 146.

It will of course be appreciated that that preceding description relates to a particular preferred embodiment of the invention and that many modifications are possible within the broad scope of the invention. Various of the components specifically discussed previously can be changed (e.g. electric motors can be substituted for air motors and vice versa) or the machine could be designed to operate using a hydraulic system if appropriate. In this case, the air cylinder 112 for actuating the gripper means of the machine would be replaced by a pneumatic cylinder and ram device. Electrically operated actuating devices can alternatively be used; for example, cylinder 112 culd be replaced by an electromagnetic actuator.

The cable and winch arrangement for raising and lowering the gripper means can also change. For example, the jib could carry a linear actuator such as a pneumatic cylinder and ram device. Cable 24 could be replaced by some other form of elongate support element such as a chain or rope.

I claim:

1. A panel laying machine, comprising: a chassis; support wheels rotatably mounted to the chassis; a mast extending upwardly from the chassis; a jib mounted on the mast for turning about a vertical axis relative to the chassis; panel gripper means including a plurality of gripping elements engageable with a panel to selectively grip or release a panel; a flexible elongate support element suspending the gripper means from the jib; drive means carried by the jib for displacing the support element to raise and lower the gripper means, the gripper means including a fluid pressure-operated device manually actuable by an operator to cause the gripping elements to selectively grip or release a panel; load sensor means for sensing the load carried by the support element and coupled to said fluid pressure-operated device so as to maintain the gripping elements in engagement with a panel and prevent release thereof while the load sensor means senses that the load carried by the support element exceeds a predetermined value; safety valve means connected to said fluid pressure-operated device; actuation means for supplying operating fluid to said device and to the load sensor means; the load sensor means being adapted to control said safety valve means to maintain the gripping elements in engagement with a panel in the event that the load sensor means senses that the load carried by the support element exceeds a predetermined value; an electric drive motor for driving the machine and connected to at least one support wheel by a transmission; an electrically driven compressor for providing a source of compressed air; said fluid pressure-operated device and support element drive means both being driven by compressed air; and inter-lock means provided in electrical supplies to the electric drive motor and to the compressor for ensuring that electrical power is only ever supplied to one of the motor and the compressor; said interlock means comprising a relay which has two input contacts, two output contacts, and a movable conduction member for bridging one pair of input and output contacts on the other pair of input and output contacts, one pair of input and output contacts being disposed in a supply line to the electric motor and the other pair of input and output contacts being disposed in a supply line to the compressor; spring biassing means being provided for urging the conduction member against the pair of input and output contacts disposed in the line to the compressor, so that power is normally supplied to the compressor.

2. A machine as claimed in claim 1, wherein the gripper means includes a first actuation switch, with the safety valve means and the first actuation switch disposed in series in a line connected to the fluid pressure-operated device, so that, in use, an operator can operate the first actuation switch to open the gripper means, when the safety valve means permits flow of operating fluid therethrough.

3. A machine as claimed in claim 2, wherein the safety valve means comprises a lock-out valve, which is disposed downstream from the first actuation switch, and wherein the gripper means includes a first control valve, which has two outlet ports connected to first and second inlet ports of the fluid pressure-operated device, and two inlet ports connected to said lockout valve and to a supply of operating fluid, respectively, which first control valve includes a spring-loaded valve member, which normally causes operating fluid to be supplied to the first inlet of the fluid pressure-operated device to maintain the gripper means closed, but under the influence of a control signal from said actuation switch delivers operating fluid to the second port of the said device to open the gripper means.

4. A machine as claimed in claim 1, wherein the fluid pressure-operated device comprises a pneumatic cylinder.

5. A machine as claimed in claim 3, wherein the lock-out valve and the first control valve are mounted on the gripper means, and wherein two hoses are provided extending along the jib, and down the support cable to the gripper means, one cable being for an operating fluid supply and the other cable being for a signal from the load sensor.

6. A machine as claimed in claim 1, wherein the gripper means comprises a support frame suspended from the support element, a main frame secured to the support frame, at least one fixed gripping element secured to the main frame and at least one movable gripping element movably mounted on the main frame, with the gripper operating means secured to the main frame.

7. A machine as claimed in claim 6, which includes two fixed gripping elements disposed diagonally opposite one another, and two movably mounted gripping elements diagonally opposite one another and perpendicular to the fixed gripping elements.

8. A machine as claimed in claim 7, wherein the main frame includes first and second elongate elements extending perpendicularly to one another with the fixed gripping elements being attached at the ends of one elongate element and with the movable gripping elements being pivotally attached at the ends of the other elongate element.

9. A machine as claimed in claim 8, wherein each movable gripping element is located in a slot in a respective end of said other elongate element and is arranged for pivotal movement about a horizontal axis, and wherein a lower end of each movable gripping element includes a catch for engaging a panel, and the fluid pressure-operated device includes two actuator rods whose free ends are pivotally attached to upper ends of the two movable gripping elements.

10. A machine as claimed in claim 9, wherein the fluid pressure-operated device comprises a pneumatic cylinder and said actuator rods, with the pneumatic cylinder secured to the main frame, and wherein the safety valve means comprises a lock-out valve and a first control valve mounted on the main frame, and wherein an actuating switch is mounted on the main frame, with pressurized operating fluid being supplied to the control valve directly and indirectly via the lock-out valve and the actuating switch, whereby, in use, the control valve normally supplies operating fluid to the pneumatic cylinder to maintain the movable gripping elements in a closed position, but, when permitted by the lock-out valve, the actuating switch can send a signal to the first control valve, so that operating fluid is supplied to the pneumatic cylinder to open the movable gripping elements.

11. A machine as claimed in claim 1, which includes a timer connected to the relay and an operating button connected to the timer, whereby the timer can operate the relay to cause power to be supplied to the electric motor for a predetermined period.

12. A machine as claimed in claim 11, wherein the timer is mounted on one of the chassis, the mast and the jib, and wherein the actuating button is mounted on the gripper means and is connected to the timer by a wire extending along the jib and down the support element.

13. A machine as claimed in claim 1, in combination with a trolley for supporting a stack of panels, the trolley being attachable to the panel laying machine.

14. A combination as claimed in claim 13, wherein the trolley includes forks for lifting a stack of panels, which forks are movable vertically and include first fastening means at their free ends, and wherein the chassis includes second fastening means for co-operation with the first fastening means, whereby, in use, the trolly can be attached to the panel laying machine by vertical displacement of the forks to bring the first and second fastening means into engagement with one another.

15. A combination as claimed in claim 14, wherein the first fastening means comprises holes in the ends of the forks and the second fastening means comprises upstanding pins of the chassis, the holes and pins being engaged with one another by downward movement of the forks.

16. The combination as claimed in claim 14, wherein the trolley includes steerable wheels and a steering lock for locking the steerable wheels, so that the panel lifting machine and the trolley can be moved together in a straight line.

17. The combination as claimed in claim 16, wherein the trolley includes steerable wheels mounted on a frame element rotatably connected to the remainder of the trolley by a shaft, and wherein the steering lock comprises a bolt engaged in a threaded bore of the frame element, for clamping it to the shaft.

18. A machine as claimed in claim 1, wherein the mast includes a flange at its lower end, by which the mast is bolted to the chassis, to enable the chassis and mast to be readily assembled and disassembled.

19. A machine as claimed in claim 1, wherein the mast includes a shaft rotatably mounted in bearings and a channel section member secured to an upper end of the shaft and provided with holes, and wherein the jib includes holes corresponding to the holes in the channel-section member, for bolting the jib to the mast, to enable the jib and mast to be readily assembled and disassembled.

20. A panel laying machine, comprising: a chassis; support wheels rotatably mounted to the chassis; a mast extending upwardly from the chassis; a jib mounted on the mast for turning about a vertical axis relative to the chassis; panel gripper means engageable with a panel to selectively grip or release a panel including a plurality of gripping elements engageable with the panel; a flexible elongate support element suspending the gripper means from the jib; drive means carried by the jib for displacing the support element to raise and lower the gripper means, the gripper means including operating means manually actuable by an operator to cause the gripping elements to selectively grip or release a panel; load sensor means for sensing the load carried by the support element and coupled to said gripper operating means so as to maintain the gripping elements in engagement with a panel and prevent release thereof while the load sensor means senses that the load carried by the support element exceeds a predetermined value; said gripper means comprising a support frame suspended from the support element, a main frame secured to the support frame, at least two fixed gripping elements secured to the main frame diagonally opposite one another, and two movable gripping elements movably mounted on the main frame diagonally opposite one another and perpendicularly to the fixed gripping elements, the gripper operating means being secured to the main frame and the main frame including first and second elongate elements extending perpendicularly to one another with the fixed gripping elements attached at the ends of one elongate element and with the movable gripping elements pivotally attached at the ends of the other elongate element, each movable gripping element being located in a slot in a respective end of said other elongate element and being arranged for pivotal movement about a horizontal axis, and a lower end of each movable gripping element including a catch for engaging a panel, the gripper operating means including two actuator rods whose free ends are pivotally attached to upper ends of the two movable gripping elements.

21. A machine as claimed in claim 20, wherein the gripper operating means comprises a pneumatic cylinder and said actuator rods, with the pneumatic cylinder secured to the main frame, and wherein the machine further includes safety valve means comprising a lock-out valve and a first control valve mounted on the main frame, and wherein an actuating switch is mounted on the main frame, with pressurized operating fluid being supplied to the control valve directly and indirectly via the lock-out valve and the actuating switch, whereby, in use, the control valve normally supplies operating fluid to the pneumatic cylinder to maintain the movable gripping elements in a closed position, but, when permitted by the lock-out valve, the actuating switch can send a signal to the first control valve, so that operating fluid is supplied to the pneumatic cylinder to open the movable gripping elements.

22. A panel laying machine, comprising: a chassis; support wheels rotatably mounted to the chassis; a mast extending upwardly from the chassis; a jib mounted on the mast for turning about a vertical axis relative to the chassis; panel gripper means including a plurality of gripping elements engageable with a panel to selectively grip or release a panel; a flexible elongate support element suspending the gripper means from the jib; drive means carried by the jib for displacing the support element to raise and lower the gripper means, the gripper means including operating means manually actuable by an operator to cause the gripping elements to selectively grip or release a panel; load sensor means for sensing the load carried by the support element and coupled to said gripper operating means so as to maintain the gripping elements in engagement with a panel and prevent release thereof while the load sensor means senses that the load carried by the support element exceeds a predetermined value; an electric drive motor for driving the machine and connected to at least one support wheel by a transmission; an electrically driven compressor, for providing a source of compressed air, wherein the gripper operating means and the support element drive means are both driven by compressed air; and inter-lock means in the electrical supplies to the electric drive motor and to the compressor, which inter-lock means ensures that electrical power is only ever supplied to one of the motor and the compressor.

23. A machine as claimed in claim 22, wherein the inter-lock means comprises a relay which has two input contacts, two output contacts, and a movable conduction member for bridging one pair of input and output contacts on the other pair of input and output contacts, with one pair of input and output contacts being disposed in a supply line to the electric motor and the other pair of input and output contacts being disposed in a supply line to the compressor, and spring biassing means being provided for urging the conduction member against the pair of input and output contacts disposed in the line to the compressor, so that the power is normally supplied to the compressor.

24. A machine as claimed in claim 23, which includes a timer connected to the relay and an operating button connected to the timer, whereby the timer can operate the relay to cause power to be supplied to the electric motor for a predetermined period.

25. A machine as claimed in claim 24, wherein the timer is mounted on one of the chassis, the mast and the jib, and wherein the actuating button is mounted on the gripper means and is connected to the timer by a wire extending along the jib and down the support element.

26. A panel laying machine, comprising: a chassis; support wheels rotatably mounted to the chassis; a mast extending upwardly from the chassis; a jib mounted on the mast for turning about a vertical axis relative to the chassis; panel gripper means including a plurality of gripping elements engageable with a panel to selectively grip or release a panel; a flexible elongate support element suspending the gripper means from the jib; drive means carried by the jib for displacing the support element to raise and lower the gripper means, the gripper means including operating means manually actuable by an operator to cause the gripping elements to selectively grip or release a panel; load sensor means for sensing the load carried by the support element and coupled to said gripper operating means so as to maintain the gripping elements in engagement with a panel and prevent release thereof while the load sensor means senses that the load carried by the support element exceeds a predetermined value; an electric drive motor for driving the machine and connected to at least one support wheel by a transmission; an electrically driven compressor for providing a source of compressed air, wherein the gripper operating means and the support element drive means are both driven by compressed air; and inter-lock means in the electrical supplies to the electric drive motor and to the compressor, which inter-lock means ensures that electrical power is only ever supplied to one of the motor and the compressor; said inter-lock means comprising a relay which has two input contacts, two output contacts, and a movable conduction member for bridging one pair of input and output contacts on the other pair of input and output contacts, one pair of input and output contacts being disposed in a supply line to the electric motor and the other pair of input and output contacts being disposed in a supply line to the compressor, and spring biassing means being provided for urging the conduction member against the pair of input and output contacts disposed in the line to the compressor, so that power is normally supplied to the compressor.

* * * * *